United States Patent [19]

Guggemos

[11] Patent Number: 4,483,643

[45] Date of Patent: Nov. 20, 1984

[54] CANAL BED SHELL

[76] Inventor: Horst Guggemos, Herbersteinstr.92, A-8052 Graz, Austria

[21] Appl. No.: 352,887

[22] Filed: Mar. 1, 1982

[30] Foreign Application Priority Data

Mar. 11, 1981 [AT] Austria ..... 1118/81

[51] Int. Cl.[3] ..... B63B 35/04

[52] U.S. Cl. ..... 405/154; 52/20

[58] Field of Search ..... 405/154; 52/20; 285/121-127

[56] References Cited

U.S. PATENT DOCUMENTS

| | | | |
|---|---|---|---|
| 1,463,461 | 7/1923 | Davis | 285/121 X |
| 1,706,811 | 3/1929 | Pearson et al. | 285/121 X |
| 1,712,510 | 5/1929 | Monie | 52/20 X |
| 2,457,418 | 12/1948 | Turpin et al. | 285/121 X |
| 2,798,504 | 7/1957 | Gast | 285/121 X |
| 4,275,757 | 6/1981 | Singer | 52/20 X |

*Primary Examiner*—Dennis L. Taylor
*Attorney, Agent, or Firm*—Salter & Michaelson

[57] ABSTRACT

A canal bed shell for use in a manhole construction consisting at least partially of tubes and carrying a liquid medium has a U-shaped or a V-shaped cross section. On at least one end of the canal bed shell is a continuation defined by a tube portion which is integrally formed with the canal bed shell and which can be tightly connected with one of the tubes. The height of the canal bed shell as measured from the bottom to the upper boundary edge is at least as great as is the internal diameter of said tubes. The canal bed shell passes over in a stepless manner into said tube at least at the area of the bottom of the canal bed shell. If required, the canal bed shell can be arcuately bent and be provided with side-channel crossings. In a preferred form of the invention a berm is formed integral with the canal bed shell and includes a recessed shoulder which receives a vertical shaft element thereon.

8 Claims, 7 Drawing Figures

FIG. 7
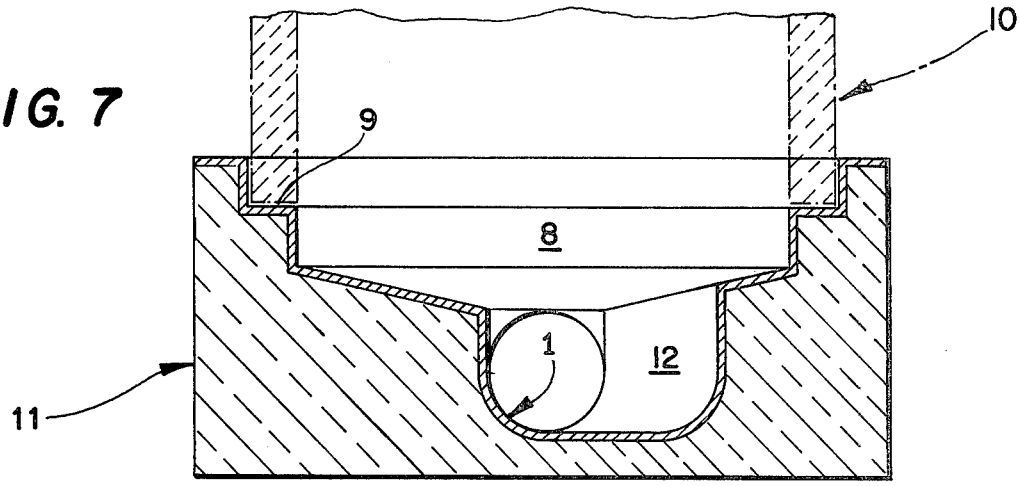
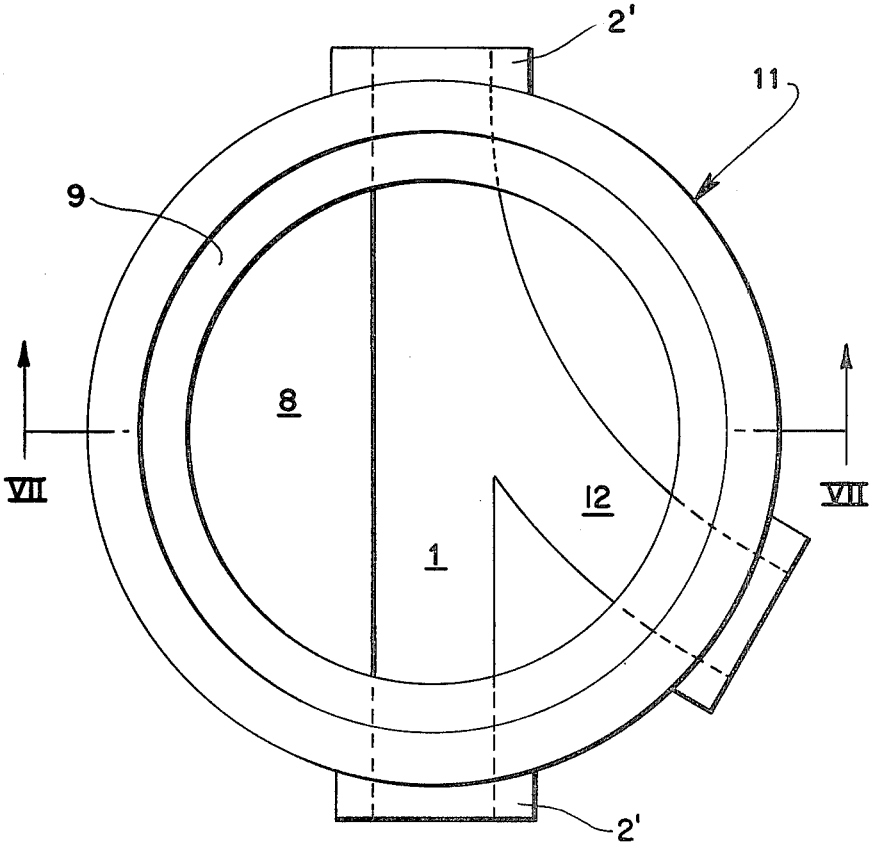
FIG. 6

CANAL BED SHELL

BACKGROUND OF THE INVENTION

1. Field of the Invention

The invention refers to a canal bed shell for a sewer or channel consisting at least partially of tubes and carrying a liquid medium.

2. The Prior Art

It is known to build sewers or channels by assembling tubes and to provide between the tubes canal bed shells at least at those positions where cleaning shafts or wells or inspection shafts are to be provided. Such cleaning wells or shafts and inspection shafts are primarily provided at those positions which are subject to become clogged, i.e. for example at the area of side-channel crossings, branchings or more pronounced changes of the direction of the sewer system.

In conventional sewers and channels, respectively, the ends of the tubes carrying the medium and to be connected one to the other by means of the canal bed shell are flush with the side walls of the shaft, the front sides of the canal bed shell bluntly contacting the tube ends. This does, however, not provide a tight connection between the ends of the tubes and the canal bed shells so that there exists the danger that at the connecting area either rising phreatic water or ground water is entering the sewer system or sewage is flowing out of the sewer system. Both phenomena are, however, unfavourable in veiw of the general intention to keep the phreatic water clean.

SUMMARY OF THE INVENTION

It is an object of the present invention to provide a canal bed shell which can be connected to the adjacent tube in a fluid-tight manner. It is a further object of the invention to provide a canal bed shell of simple construction and providing the possibility to realize the mentioned fluid-tight connection with the adjacent tube in a simple manner. It is a further object of the invention to design the canal bed shell such that this shell can completely receive an even high amount of liquid so that the liquid medium carried by the sewer or channel can not flow into the phreatic water. Moreover, it is an object of the invention to design a canal bed shell such that a stepless area of transition between the inner surface of the canal bed shell and the tube connected thereto is reliably obtained so that sedimentations of solid matter carried by the liquid medium are avoided, which sedimentations could result in clogging the sewer system. It is an additional object of the invention to design the canal bed shell such that the direction of the canal can be changed and side-channel crossings can be provided within the area of the canal bed shell. Finally it is an object of the invention to provide a canal bed shell which is designed such that this shell forms the whole floor of the cleaning shaft or inspection shaft receiving the canal bed shell so that this shaft often need not be separately manufactured.

BRIEF DESCRIPTION OF THE DRAWINGS

The invention is schematically illustrated with reference to the annexed drawings.

FIGS. 6 and 7 show a modified form of the channel as formed in the canal bed shell.

DETAILED DESCRIPTION OF EMBODIMENTS OF THE INVENTION

Figure 1:
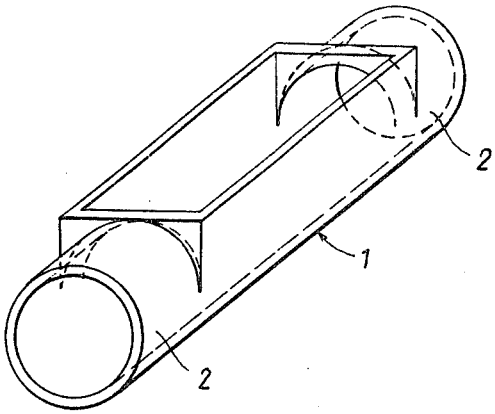
FIG. 1 shows a canal bed shell according to the invention in a perspective view.
Figure 2:
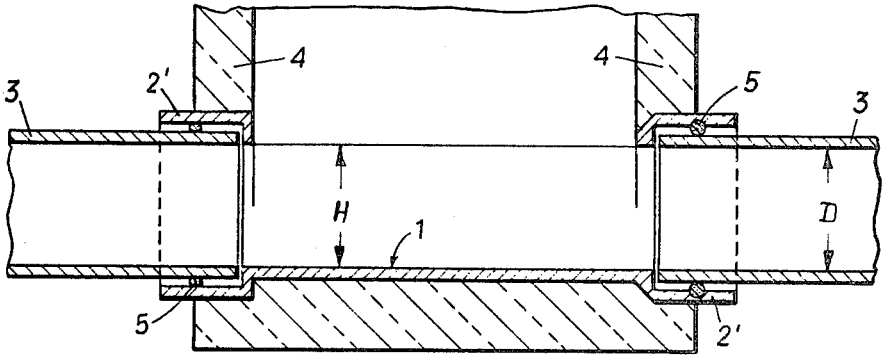
FIGS. 2 and 3 show in a section two different embodiments of a canal bed shell arranged within a shaft.

The canal bed shell 1 shown in FIG. 2 has a U-shaped cross-section. It is, however, also possible to use a cross section of V-shape with rounded bottom portion. The canal bed shell 1 has on both of its ends an integral tube portion which is in the represention of FIG. 1 designed as a simple tube end but which is, according to a preferred embodiment shown in FIG. 2, provided with a socket 2' as can be derived from FIG. 2, the canal bed shell 1 is tightly connected with the adjacent tubes 3 by means of this socket 2'. Tightening between the socket 2' and the tubes 3 is effected by inserted sealing rings 5 or the like, preferably rubber rings, different posibilities being shown in the right hand portion and in the left hand portion of FIG. 2.

For the purpose of preventing clogging it is convenient that the inner surface of the canal bed shell and, respectively, of the tube portions being integral therewith pass over in a stepless manner into the inner surface of the adjacent tubes 3. In the embodiment according to FIG. 1 the internal diameter of the tube portions 2 is therefore equal to the internal diameter of the tubes 3. For the purpose of reliably establishing in the embodiment according to FIG. 2 a stepless transition between the inner surface of the tube 3 and of the canal bed shell it is necessary to make the internal radius of the socket 2' greater for at least the wall thickness of the tubes 3 than is the radius of curvature of the canal bed shell 1 as is shown in the drawing.

Figure 3:
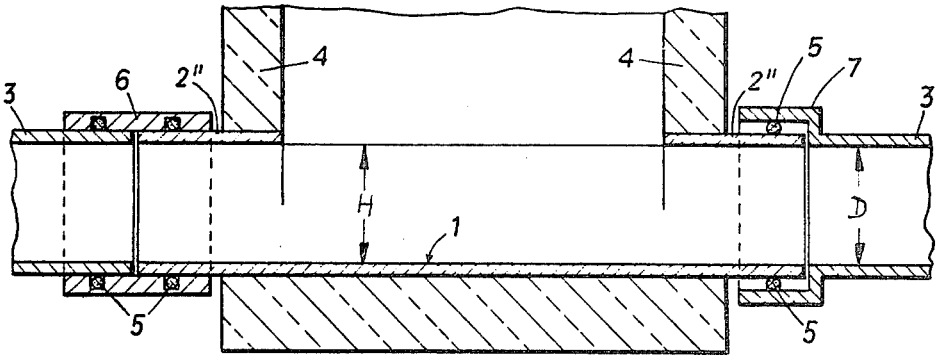

In the embodiment according to FIG. 3, a tube portion 2'' designed as a simple tube and is connected with the canal bed shell 1, half of the internal diameter of this tube portion being equal to the internal radius of the canal bed shell 1 and equal one half of the internal diameter of the tubes 3 to be connected. In the embodiments shown in the left hand portion of FIG. 3, the tube portion 2'' and the tube 3 are bluntly engaging one another with their front faces and a coupling sleeve 6 is placed around the connecting area, a fluid tight seal being also in this case effected by means a sealing ring 5 of rubber or the like. The coupling sleeve 6 is of exactly of the same construction as is a conventional coupling sleeve used for connecting two tubes. In the embodiment shown in the right hand portion of FIG. 3, the end of the tube 3 is provided with a coupling sleeve 7 to be shifted onto the tube portion 2'', a fluid tight seal being also this case effected by means of a sealing ring 5 or rubber or the like.

Figure 4:
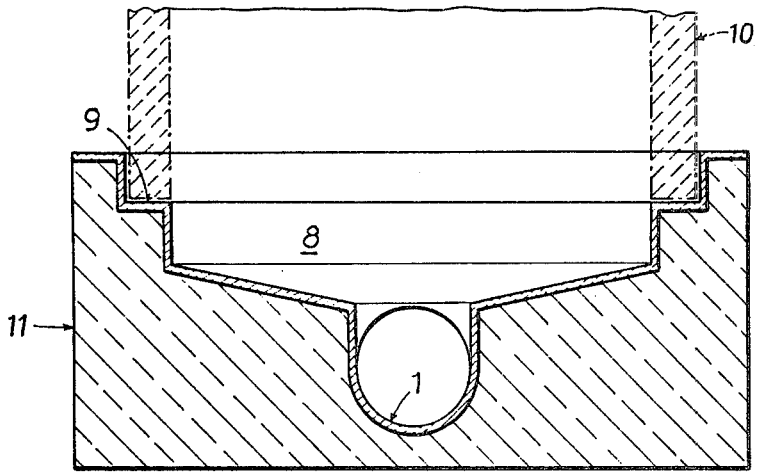
FIG. 4 shows in a section along line IV—IV of FIG. 5 a canal bed shell being integrally formed with a berm.
Figure 5:
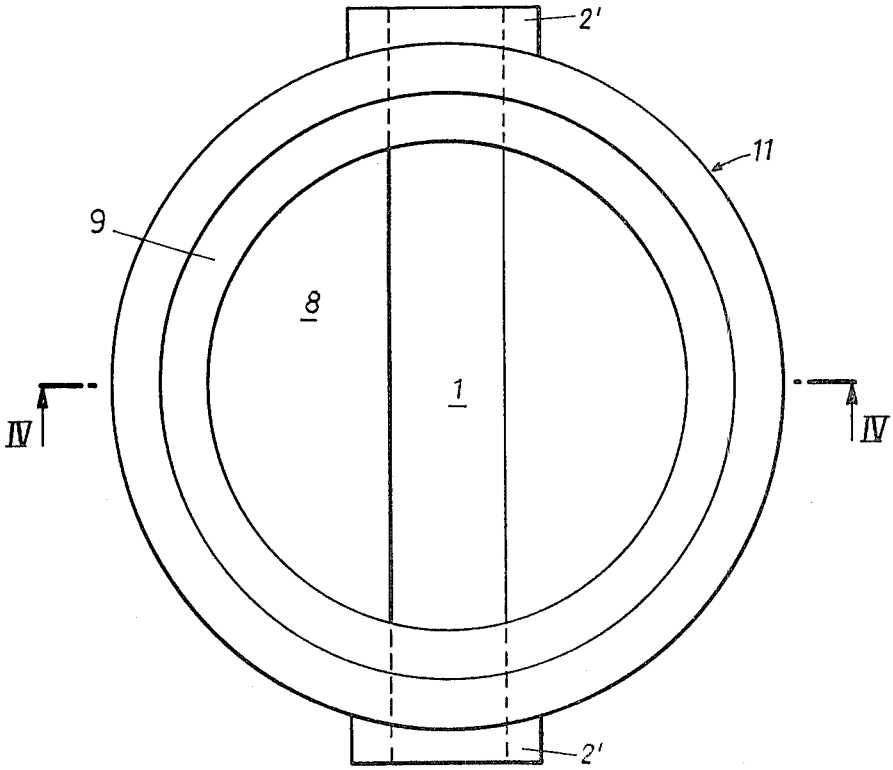
FIG. 5 shows the canal bed shell of FIG. 4 in a top plan view.

In the embodiment according to FIG. 4 and 5, the canal bed shell 1 having integrally formed thereto the tube portions or, respectively, the sockets 2'' is integrally formed with a berm 8. This berm 8 forming the shaft bottom is provided with a recessed shoulder 9 into which a shaft element 10, for example a ring of concrete, asbestos-cement or the like, can be inserted. A construction part 11 of concrete or the like is cast onto the berm 8 thus providing a finished part consisting of the berm and the constructional part 11 and to be lowered into ground or a bed of concrete is provided at the location where the shaft is to be erected and the berm 8 is anchored within this bed of concrete. In both cases, the one-piece construction consisting of the berm 8 and of the canal bed shell 1 is substantially facilitating the erection of the shaft and provides a completely fluid tight seal, so that any contamination of the phreatic water can reliably be prevented. By providing the recessed shoulder 9, the shaft elements 10 are automatically brought in correct position during assembling work and a tight seal can be provided between the berm 8 and the shaft elements 10 by suitable measures such as placing therebetween a jointing compound or the like.

For the purpose of giving the canal bed shell 1 a capacity sufficient to receive the whole amount of liquid medium which can flow through the tubes 3, the height H of the canal bed shell, i.e. the distance between the bottom of the canal bed shell and its upper boundary edge is at least as great as is the internal diameter D of the tube 3.

In all embodiments, the tube portions and, respectively, the sockets 2, 2', 2'' are flush with the internal side of the shaft wall 4 at the area of connection with the canal bed shell 1. This prevents the formation of sediments which could be created on portions of the tube portions or sockets protruding into the shaft.

With all embodiments, the canal bed shell 1 and the tube portions 2, 2', 2'' connected thereto can also be curved, for example be arcuate in shape, for the purpose of changing the direction of the piping at the area of the cleaning shafts and, respectively, inspection shafts. An example of a canal bed shell 1 having a curved portion 12 is illustrated in FIGS. 6 and 7. It is further possible to provide at the area of the canal bed shell 1 side-channel crossings with all without a tube portion connected thereto.

What I claim is:

1. A manhole construction comprising a vertical shaft that provides for access to a liquid conveying sewer system therebelow, a canal bed shell that is disposed beneath said shaft and that is accessible therethrough, said canal bed shell including an open top bottom portion that has a generally U-shaped configuration and that defines a channel therein, tube portions joined to opposite ends of said bottom portion and communicating with said channel, the height of said bottom portion being defined by the height of said channel as formed therein and, the height of said bottom portion being substantially the same as the interior diameter of said tube portions wherein smooth and uninterrupted flow of liquid through said channel is provided, said canal bed shell further including a berm portion that defines planar surfaces that are located adjacent to said channel and that are formed as an integral part of said bottom portion, the peripheral edges of said berm portion being generally curved in configuration, a shoulder being formed in said body portion adjacent to the peripheral edges of said berm portion and defining an annular shelf, said vertical shaft being received on said annular shelf in sealing relation and providing access through the interior thereof to said canal bed shell, tubes forming part of said sewer system sealingly engaging said tube portions, the internal diameter of said tube portions having substantially the same diameter as the internal diameter of said tubes, wherein liquid can flow uninterruptedly through said channel without becoming clogged therein.

2. A manhole construction as claimed in claim 1, wherein the tube portion being integrally formed with said canal bed shell consists at least partially of a socket into which the end of the said tube can be inserted.

3. A manhole construction as claimed in claim 1, wherein the outer diameter of the tube portion is as great as the external diameter of the said tube, a coupling sleeve being placed around the adjacent ends of the tube portion and of the said tube.

4. A manhole construction as claimed in claim 1, wherein one half of the diameter of the said tube corresponds to the internal radius of curvature of said canal bed shell and wherein the inner surface of the said tube passes over into the canal bed shell in a stepless manner.

5. A manhole construction as claimed in claim 1, said channel including at least one portion that is arcuate in configuration.

6. A manhole construction as claimed in claim 1, wherein at least one tube portion is arcuately bent.

7. A manhole construction as claimed in claim 1, said canal bed shell further being formed with at least one side-channel crossing.

8. A manhole construction as claimed in claim 1, said canal bed shell that includes said body portion, berm portion and tube portions being embedded in a foundation that defines the bottom of said manhole construction.

* * * * *